US008689701B2

(12) United States Patent
Sun et al.

(10) Patent No.: US 8,689,701 B2
(45) Date of Patent: Apr. 8, 2014

(54) RAILROAD CAR WHEEL TRUCK

(71) Applicant: CSR Yangtze Co., Ltd., Wuhan (CN)

(72) Inventors: Mingdao Sun, Wuhan (CN); Yong Xu, Wuhan (CN); Baolei Wang, Wuhan (CN); Yongjiang Li, Wuhan (CN)

(73) Assignee: CSR Yangtze Co., Ltd., Wuhan (CN)

( * ) Notice: Subject to any disclaimer, the term of this patent is extended or adjusted under 35 U.S.C. 154(b) by 0 days.

(21) Appl. No.: 13/661,013

(22) Filed: Oct. 25, 2012

(65) Prior Publication Data

US 2013/0047882 A1 Feb. 28, 2013

Related U.S. Application Data

(63) Continuation-in-part of application No. PCT/CN2010/079594, filed on Dec. 9, 2010.

(30) Foreign Application Priority Data

Apr. 27, 2010 (CN) ..... 2010 1 0162226

(51) Int. Cl.
*B61F 3/00* (2006.01)

(52) U.S. Cl.
USPC ..... 105/197.05; 105/198.2

(58) Field of Classification Search
USPC ..... 105/196, 197.05, 197.1, 197.2, 198, 105/198.1, 198.2, 198.3, 198.4, 198.5, 105/198.6, 199.3, 199.4
See application file for complete search history.

(56) References Cited

U.S. PATENT DOCUMENTS

| | | | | |
|---|---|---|---|---|
| 5,138,954 | A * | 8/1992 | Mulcahy | 105/199.3 |
| 5,752,564 | A * | 5/1998 | Callahan et al. | 164/137 |
| 5,806,435 | A * | 9/1998 | Pitchford | 105/199.3 |
| 5,954,114 | A * | 9/1999 | Bauer et al. | 164/137 |
| 6,196,134 | B1 * | 3/2001 | Stecker | 105/226 |
| 6,354,226 | B2 * | 3/2002 | Stecker | 105/226 |
| 6,622,776 | B2 * | 9/2003 | Bauer et al. | 164/137 |
| 6,659,016 | B2 * | 12/2003 | Forbes | 105/355 |
| 6,672,224 | B2 * | 1/2004 | Weber et al. | 105/187 |
| 7,681,506 | B2 * | 3/2010 | Forbes et al. | 105/226 |
| 7,823,513 | B2 * | 11/2010 | Forbes et al. | 105/193 |
| 8,413,592 | B2 * | 4/2013 | Forbes et al. | 105/453 |
| 2001/0054368 | A1 * | 12/2001 | Taillon | 105/198.2 |
| 2004/0129168 | A1 * | 7/2004 | Forbes | 105/197.05 |
| 2008/0229968 | A1 * | 9/2008 | Gedenk et al. | 105/198.7 |
| 2009/0242335 | A1 * | 10/2009 | Taylor | 188/47 |

(Continued)

FOREIGN PATENT DOCUMENTS

WO WO 2008070953 A1 * 6/2008 ..... B61F 5/52

*Primary Examiner* — Jason C Smith
(74) *Attorney, Agent, or Firm* — Matthias Scholl P.C.; Matthias Scholl

(57) ABSTRACT

A wheel truck, including: a front wheel pair assembly and a rear wheel pair assembly, two side frame assemblies, two spring suspension devices, and a bolster assembly. The spring suspension devices include a bearing spring unit, a damping spring, and a wedge. The wedge includes a primary friction surface and a secondary friction surface. The primary friction surface is attached to a column surface of the side frame assembly. The secondary friction surface is attached to an inclined surface of the bolster assembly. The wedge has the following structure parameters: $\alpha$=16-30°, and $\mu<tg\alpha<\mu+\mu_1$, in which a represents an included angle between the secondary friction surface and a vertical plane, $\mu$ represents a friction coefficient of the primary friction surface, and $\mu_1$ represents a friction coefficient of the secondary friction surface.

2 Claims, 5 Drawing Sheets

(56) References Cited

U.S. PATENT DOCUMENTS

| | | | | |
|---|---|---|---|---|
| 2010/0107923 | A1* | 5/2010 | Rodet et al. | 105/197.05 |
| 2010/0162919 | A1* | 7/2010 | Aitken et al. | 105/198.2 |
| 2011/0036264 | A1* | 2/2011 | Sammartino | 105/198.2 |
| 2011/0185939 | A1* | 8/2011 | Forbes et al. | 105/168 |
| 2012/0318165 | A1* | 12/2012 | Xu et al. | 105/197.05 |
| 2012/0318166 | A1* | 12/2012 | Wike | 105/198.2 |
| 2013/0008337 | A1* | 1/2013 | Liu et al. | 105/198.2 |
| 2013/0047882 | A1* | 2/2013 | Sun et al. | 105/198.2 |
| 2013/0055922 | A1* | 3/2013 | Sun et al. | 105/197.05 |

* cited by examiner

RAILROAD CAR WHEEL TRUCK

CROSS-REFERENCE TO RELATED APPLICATIONS

This application is a continuation-in-part of International Patent Application No. PCT/CN2010/079594 with an international filing date of Dec. 9, 2010, designating the United States, now pending, and further claims priority benefits to Chinese Patent Application No. 201010162226.3 filed Apr. 27, 2010. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 14781 Memorial Drive, Suite 1319, Houston, Tex. 77079.

BACKGROUND OF THE INVENTION

1. Field of the Invention

The invention relates to a wheel truck, and more particularly to a railroad freight car wheel truck.

2. Description of the Related Art

As a critical part of a freight car, a typical railroad freight car wheel truck includes two side frame assemblies and a bolster assembly. Journal-box guides disposed on two ends of the side frame assembly are fixed on a front wheel pair and a rear wheel pair via roller bearing adapters and bearing assemblies, respectively. Each end of the bolster assembly is mounted in a central square box of the side frame assembly via a spring suspension device. The spring suspension device includes a bearing spring unit in the center, two damping springs on both sides, and two wedges each of which is disposed on a top of each damping spring. A vertical primary friction surface and an inclined secondary friction surface of the wedge contact with a column surface of the side frame assembly and an inclined surface of the bolster assembly, respectively. The bearing spring units, the damping springs, together with the corresponding wedges bear the load of the bolster assembly.

On each end of the upper surface of the bolster assembly a side pedestal is arranged. The side pedestals and a center plate of the bolster assembly bear the load of the freight car. The wheel truck further includes a basic braking device for braking.

The wheel truck, as described above, is advantageous in its simple structure, uniform distribution of the load, low cost in production and maintenance However, the connection between the bolster assembly and the side frame assembly is loose and the diamond resistant rigidity is low, which cannot resist the violent shaking between the bolster assembly and the side frame assembly. And when the wheel truck runs on a curved rail track, the attack angle between the wheel pairs and the rail enlarges, thereby resulting in damages on the wheel and the rail.

Particularly, the wedge of the spring suspension device has a relative larger apex angle, that is, the angel between the secondary friction surface and a vertical plane is about 35-70°. Thus, the diamond resistant rigidity is highly limited. When the bolster assembly moves downwards relative to the side frame assembly, a vertical force component of a force from the inclined surface to the wedge is larger than a sum of vertical force components of the friction produced on the primary friction surface of the wedge and the friction produce on the secondary friction surface of the wedge, so that the wedge moves downwards, and the vertical distance between the bolster assembly and the side frame assembly becomes smaller, thereby resulting in relative rotation between the bolster assembly and the side frame assembly, as well as diamond deformation. In such a condition, the critical speed of the wheel truck is low, which limits the running speed and running performance of the freight car, and cannot meet the requirement of the speed-raising freight car.

To solve the above problems, the existing speed-raising trains employs a cross supporting device or a spring plank between two side frame assemblies for improving the diamond resistant rigidity of the conventional railroad freight car wheel truck. The problem is that, such a cross supporting device or spring plank has a complicated structure, heavy weight, and high production and maintenance costs. Thus, it is very significant to improve the conventional railroad freight car wheel truck and to design a wheel truck that has a high diamond resistant rigidity and a superb dynamic performance.

SUMMARY OF THE INVENTION

In view of the above-described problems, it is one objective of the invention to provide a wheel truck that has a simple structure, low production and maintenance costs, superb dynamic performance for crossing curved tracks, and meets high requirements of the diamond resistant rigidity for the speed-raising trains.

To achieve the above objective, in accordance with one embodiment of the invention, there is provided a wheel truck, comprising: a front wheel pair assembly and a rear wheel pair assembly, each wheel pair assembly comprising bearing assemblies on two ends; two side frame assemblies, each side frame assembly comprising a square box in the center and journal-box guides on two ends, and the journal-box guides being disposed on the bearing assemblies via roller bearing adapters; two spring suspension devices, the two spring suspension devices being disposed in the square boxes of the two side frame assemblies, respectively; and a bolster assembly comprising two ends which are disposed in the two spring suspension devices, respectively. The spring suspension devices comprise a bearing spring unit, a damping spring disposed on each side of the bearing spring unit, and a wedge disposed on a top of the damping spring. The wedge comprises a primary friction surface and a secondary friction surface. The primary friction surface is attached to a column surface of the side frame assembly. The secondary friction surface is attached to an inclined surface of the bolster assembly. The wedge is provided with the following structure parameters: a=16-30°, and $\mu<tg\alpha<\mu+\mu_1$, in which a represents an included angle between the secondary friction surface and a vertical plane, $\mu$ represents a friction coefficient of the primary friction surface, and $\mu_1$ represents a friction coefficient of the secondary friction surface.

The included angle a the wedge is limited to no more than 30°, which is much smaller than the conventional vertex angle of 35-70°, and meets the requirement that $tg\alpha<\mu+\mu1$. Thus, when the bolster moves in a horizontal direction relative to the side frame assembly, a downward vertical force component of a force exerted on the wedge from the inclined surface of the bolster remains smaller than a sum of upward vertical force components of the friction produced on the primary friction surface of the wedge and the friction produced on the secondary friction surface of the wedge, so that the wedge is limited from moving downwards, relative rotation between the bolster assembly and the side frame assembly cannot occur, and a high diamond resistant rigidity is maintained between the bolster assembly and the side frame assembly. Supposing that, the value of the angle $\alpha$ is too small and approximates to the friction angle of the primary friction of the wedge, the wedge is apt to be self-limited once the bolster assembly moves downwards relative to the side frame assembly, thereby lowering the dynamic performance of the wheel truck. Therefore, the lower bound of the included angle $\alpha$ of the wedge is designed as 16°, and $\mu<tg\alpha$, to make sure that the wedge moves freely during the vertical movement of the bolster assembly, and the wheel truck has a good dynamic performance for crossing curved tracks.

In a class of this embodiment, a width of the wedge is L=200-600 mm, which is at least 1.3 times longer than the width of the conventional wedge having a variable friction. The wedge having a variable friction herein means that a wedge is disposed on a damping spring which is arranged in a square box in a center of a side frame, the damping friction exerted on the wedge changes in proportion to the variable vertical load exerted on the bolster assembly. The width design of the wedge not only increases the torque arm length of the wedge to resist the diamond deformation between the bolster assembly and the side frame assembly, but also increases the contact area between the primary friction surface and the column surface of the side frame assembly, and the contract surface between the secondary friction surface and the inclined surface of the bolster assembly. Thus, the diamond resistant rigidity between the bolster assembly and the side frame assembly is further improved.

In a class of this embodiment, a mechanical property of the damping spring meets the following formula: $K_1 \times ctg\alpha = K \times C/2\mu$; $K_1$ represents a rigidity of the damping spring; K represents a total rigidity of the spring suspension device; C represents a relative friction coefficient of the railroad freight car wheel truck and ranges from 0.05 to 0.15; and $\mu$ represents a friction coefficient of the primary friction surface. As the rigidity $K_1$ of the damping spring is inversely proportional to ctga of the wedge, $K_1$ can be adjusted according to the value of the angle $\alpha$, thereby maintaining a suitable friction damping force, and preventing frictions from being too large during movements in vertical and horizontal directions.

Advantages of the invention are summarized hereinbelow.

First of all, the freight care wheel truck of the invention employs a wedge having a small vertex angle, which not only assures a free movement of the wedge when the bolster moves in a vertical direction, but also limits the wedge from moving when the bolster moves in a horizontal direction. Thus, the wheel truck has a high diamond resistant rigidity and good dynamic performance even without a cross supporting device or a spring plank. Furthermore, the design of the width of the wedge which is 1.3 times longer than that of the conventional wedges also improves the diamond resistant rigidity and the dynamic performance, thereby highly improving the critical speed of the freight car, the capacity of curved track crossing, and the running performance. Finally, the freight car wheel truck has a simple structure, light weight, and low production and maintenance costs, which is applicable to the new railroad freight car having a running speed of 120 km/h, and meets the requirements of the diamond resistant rigidity for the speed-raising trains.

BRIEF DESCRIPTION OF THE DRAWINGS

The invention is described hereinbelow with reference to the accompanying drawings, in which.

DETAILED DESCRIPTION OF THE EMBODIMENTS

To further illustrate the invention, experiments detailing a wheel truck are described below. It should be noted that the following examples are intended to describe and not to limit the invention.

Figure 1:
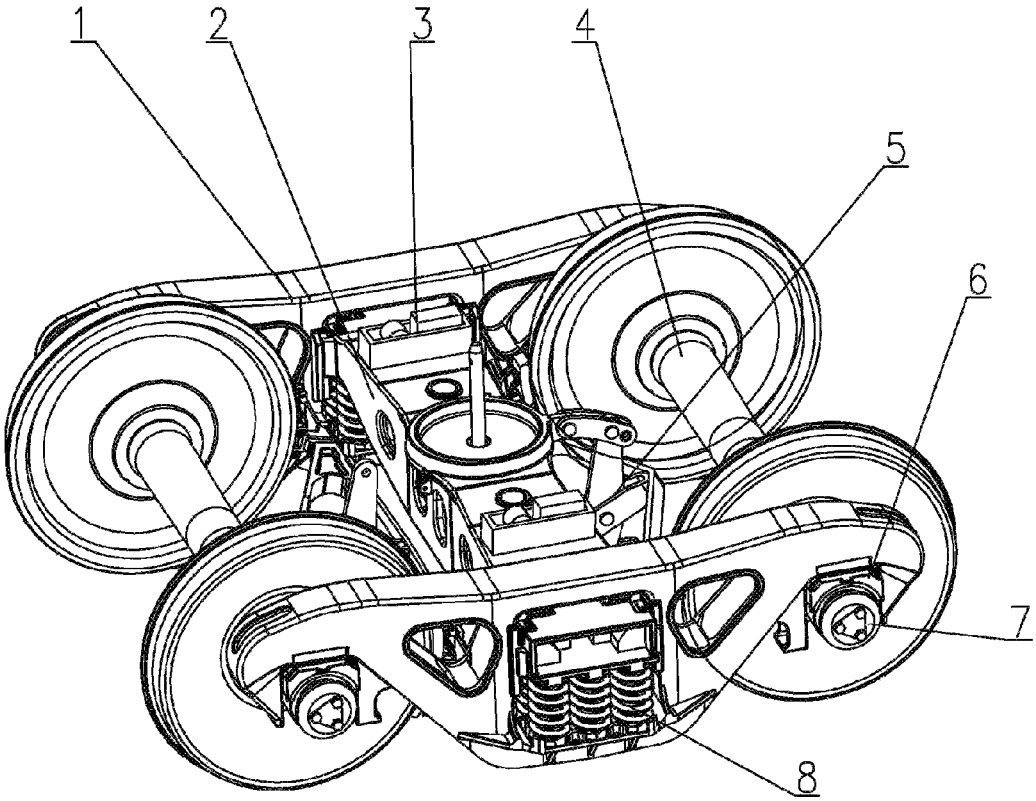
FIG. 1 is a stereogram of a railroad freight car wheel truck having a high diamond resistant rigidity in accordance with one embodiment of the invention.

As shown in FIG. 1, a wheel truck having a high diamond resistant rigidity comprises a front wheel pair assembly 4 and a rear wheel pair assembly 4, two side frame assemblies 1, a bolster assembly 2, two spring suspension devices 8, two side pedestals 3, and a basic braking device 5. The wheel pair assembly 4 comprises bearing assemblies 7 on two ends. The side frame assemblies 1 comprise journal-box guides on two ends, and the journal-box guides are disposed on the bearing assemblies 7 via roller bearing adapters 6. Two ends of the bolster assembly 2 are respectively disposed in the spring suspension devices 8 which are disposed within square boxes in the center of the side frame assemblies 1.

Figure 2:
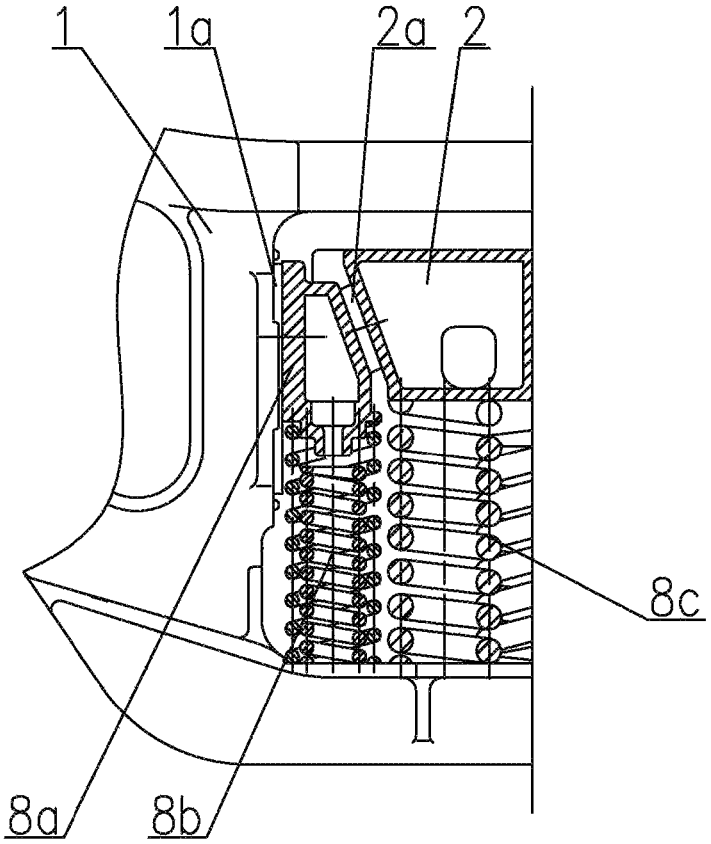
FIG. 2 is a cross-sectional view of a spring suspension device of FIG. 1.

As shown in FIG. 2, the spring suspension devices 8 comprise a bearing spring unit 8*c*, a damping spring 8*b* disposed on each side of the bearing spring unit 8*c*, and a wedge 8*a* disposed on a top of each damping spring 8*b*. A lower end of the bearing spring unit 8*c* and a lower end of the damping spring 8*b* press on a spring plank of the square box of the side frame assembly 1. The wedge 8*a* comprises a primary friction surface $\mathbf{8}a_1$ and a secondary friction surface $\mathbf{8}a_2$. The primary friction surface $\mathbf{8}a_1$ is vertical and attached to a column surface 1*a* of the side frame assembly 1; and the secondary friction surface $\mathbf{8}a_2$ is inclined and attached to an inclined surface 2*a* of the bolster assembly 2. Thus, the magnitude of the damping friction of the wedge 8*a* is in proportion to the vertical load exerted on the bolster assembly 2. The wedge 8*a* is a kind of wedge having a variable friction and plays an important role in damping when the wheel truck supports different weight of loads.

Figure 3:
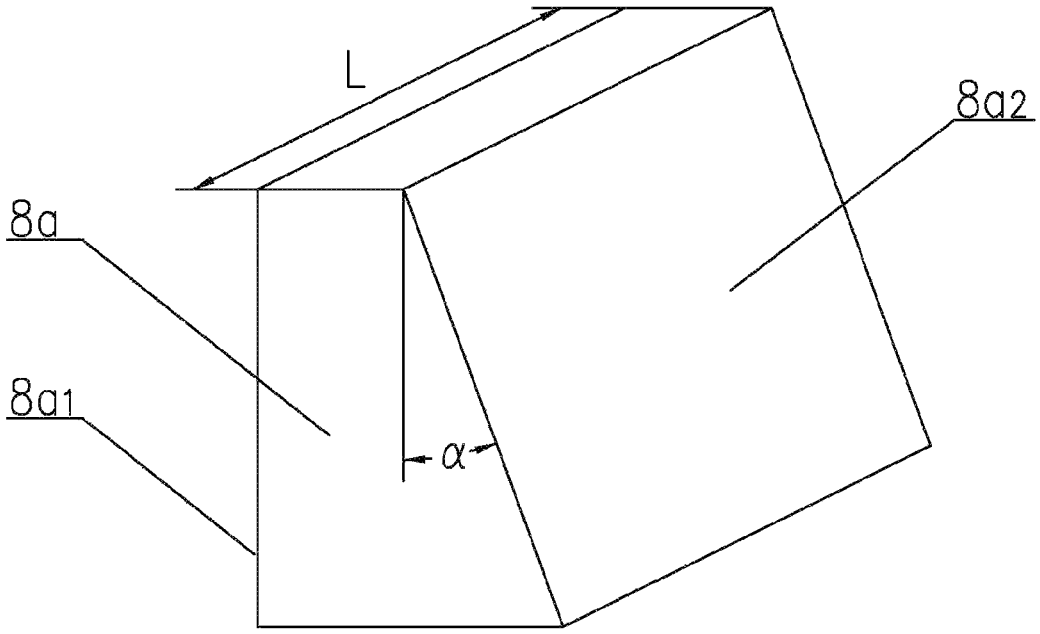
FIG. 3 is a structure parameter diagram of a wedge of a spring suspension device of FIG. 2.

As shown in FIG. 3, main structure parameters of the wedge 8*a*, such as L and $\alpha$, are labeled. Of them, L represents a width of the wedge, and $\alpha$ represents an included angle between the secondary friction surface $\mathbf{8}a_1$ and a vertical plane. L and a meet the following formulas: L=200-260 mm, $\alpha$=16-30°, and $\mu<tg\alpha<\mu+\mu_1$. $\mu$ represents a friction coefficient of the primary friction surface $\mathbf{8}a_1$; and $\mu_1$ represents a friction coefficient of the secondary friction surface $\mathbf{8}a_2$. Based on the requirement of the included angle $\alpha$, proper materials or structures are selected to make values $\mu$ and $\mu_1$ meet the requirement of the design.

Figure 4:
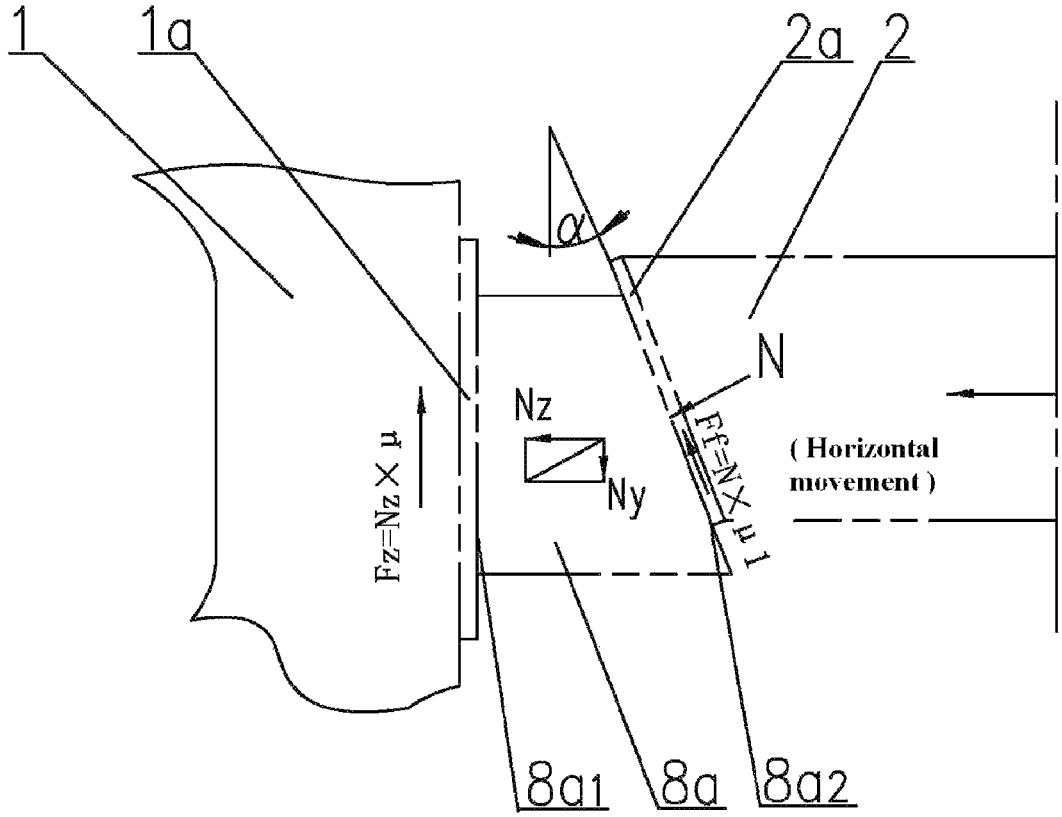
FIG. 4 is a force balance diagram of a wedge of a spring suspension device as shown in FIG. 2 during a movement of a bolster in horizontal direction.

As shown in FIG. 4, when the bolster assembly moves in a horizontal direction relative to the side frame assembly, the inclined surface 2*a* of the bolster assembly exerts a force N on the wedge 8*a*, then, a fiction $F_f$ is produced between the inclined surface 2*a* of the bolster assembly and the secondary friction surface $\mathbf{8}a_2$ of the wedge 8*a*, and a fiction $F_z$ is produced between the column surface 1*a* and the primary friction surface $\mathbf{8}a_1$ of the wedge 8*a*. It is known from FIG. 4 that a vertical force component of N is $N_y$=N x sin$\alpha$, and a horizontal force component of N is $N_z=N\times\cos\alpha$. In addition, two upward frictions are exerted on the wedge 8*a* on the primary friction surface 8*a*$_1$ and the secondary friction surface 8*a*$_2$, respectively, in which, the friction produced on the primary friction surface 8*a*$_1$ is $F_z=N_z\times\mu=N\times\cos\alpha\times\mu$, and the friction produced on the secondary friction surface 8*a*$_2$ is $F_f=N\times\mu_1$. According to the requirement that $N_y<F_z+F_f\times\cos\alpha$, that is, $N\times\sin\alpha<N\times\cos\alpha\times\mu+N\times\mu_1\cos\alpha$, a relation formula $tg\alpha<\mu+\mu_1$ is concluded after simplification. Thus, the wedge 8*a* is limited by the frictions produced on the primary friction surface 8*a*$_1$ and the secondary friction surface 8*a*$_2$ from moving downwards, and a high diamond resistant rigidity between the bolster assembly and the side frame assembly is achieved.

Figure 5:
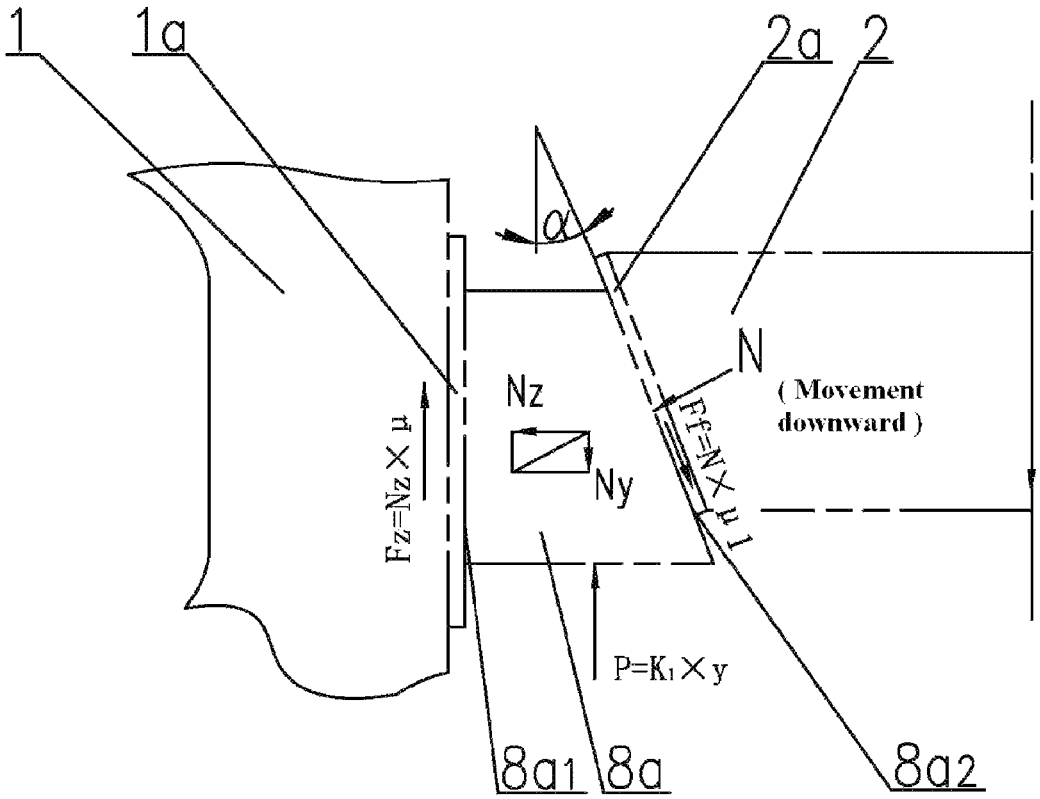
FIG. 5 is a force balance diagram of a wedge of a spring suspension device as shown in FIG. 2 during a downward movement of a bolster in vertical direction.

As shown in FIG. 5, when the bolster assembly moves downwards in a vertical direction relative to the side frame assembly, the inclined surface 2*a* of the bolster assembly exerts a force N on the wedge 8*a*, then, a fiction $F_f$ is produced between the inclined surface 2*a* of the bolster assembly and the secondary friction surface 8*a*$_2$ of the wedge 8*a*, and a fiction $F_z$ is produced between the column surface 1*a* and the primary friction surface 8*a*$_1$ of the wedge 8*a*. It is known from FIG. 5 that a vertical force component of N is $N_y=N\times\sin\alpha$, and a horizontal force component of N is $N_z=N\times\cos\alpha$. At this moment, two frictions are exerted on the wedge 8*a*, of them, the friction produced on the primary friction surface $F_z$ is upward, and the friction produced on the secondary friction surface $F_f$ is downward, and $F_z=N_z\times\mu=N\times\cos\alpha\times\mu$. According to the requirement that $F_z<N_y$, that is, $N\times\cos\alpha\times\mu<N\times\sin\alpha$, a relation formula $\mu<tg\alpha$ is concluded after simplification. In such a way, the wedge 8*a* is not limited by the friction produced on the primary friction surface, and can move freely when the bolster assembly moves in vertical direction, thereby achieving a normal attenuation vibration of the wheel truck during the running of the freight car.

It is also known from FIG. 5 that the damping force exerted on the wedge 8*a* is mainly from the friction $F_z$ produced on the primary friction surface 8*a*$_1$, and $F_z$ is relevant to a bearing capacity P of the damping spring 8*b*. The relation formula between $F_z$ and P is $F_z=P\times ctg\alpha\times\mu$, in which, $P=K_1\times y$. $K_1$ represents a rigidity of the damping spring 8*b*; and y represents a flexibility of the damping spring 8*b*. Thus, the formula above is converted as $F_z=K_1\times y\times ctg\alpha\times\mu$. In order to remain a suitable damping force for the wedge 8*a*, a mechanical property of the damping spring 8*b* should meet the following requirement: $K_1\times ctg\alpha=K\times C/2\mu$, in which, K represents a total rigidity of the spring suspension devices 8, and C represents a relative friction coefficient of the railroad freight car wheel truck and ranges from 0.05 to 0.15. As values of K and $\mu$ are determined by the requirements of design, when $\alpha$ is decreased, the ctga decreases accordingly, and the damping spring 8*b* should be selected from materials having a lower rigidity $K_1$, to make the relative friction coefficient of the wheel truck remains in the range of 0.05-0.15, and to prevent frictions from being too large during movements in vertical and horizontal directions.

The above structure of the freight car wheel truck, has a high diamond resistant rigidity, high critical speed, and superb dynamic performance for crossing curved tracks, even without adopting a cross supporting device or a spring plank. Thus, it is applicable to the new railroad freight car having a running speed of 120 km/h, and meets the requirement for speed-raising.

While particular embodiments of the invention have been shown and described, it will be obvious to those skilled in the art that changes and modifications may be made without departing from the invention in its broader aspects, and therefore, the aim 1n the appended claims is to cover all such changes and modifications as fall within the true spirit and scope of the invention.

The invention claimed is:

1. A wheel truck, comprising:

a) a front wheel pair assembly (4) and a rear wheel pair assembly (4), each wheel pair assembly (4) comprising bearing assemblies (7) on two ends;

b) two side frame assemblies (1), each side frame assembly comprising a square box in the center and journal-box guides on two ends, and the journal-box guides being disposed on the bearing assemblies (7) via roller bearing adapters (6);

c) two spring suspension devices (8), the two spring suspension devices (8) being disposed in the square boxes of the two side frame assemblies, respectively; and d) a bolster assembly (2) comprising two ends which are disposed in the two spring suspension devices (8), respectively;

wherein:

the spring suspension devices (8) comprise a bearing spring unit (8*c*), a damping spring (8*b*) disposed on each side of the bearing spring unit (8*c*), and a wedge (8*a*) disposed on a top of the damping spring (8*b*);

the wedge (8*a*) comprises a primary friction surface (8*a*$_1$) and a secondary friction surface (8*a*$_2$);

the primary friction surface (8*a*$_1$) is attached to a column surface (1*a*) of the side frame assembly (1);

the secondary friction surface (8a$_2$) is attached to an inclined surface (2*a*) of the bolster assembly (2);

the wedge (8*a*) is provided with the following structure parameters: $\alpha=16\text{-}30°$, and $\mu<tg\alpha<\mu+\mu_1$, in which $\alpha$ represents an included angle between the secondary friction surface (8*a*$_2$) and a vertical plane, $\mu$ represents a friction coefficient of the primary friction surface (8*a*$_1$), and $\mu_1$ represents a friction coefficient of the secondary friction surface (8*a*$_2$); and a mechanical property of the damping spring (8*b*) meets the following formula: $K_1\times ctg\alpha=K\times C/2\mu$, in which $K_1$ represents a rigidity of the damping spring (8*b*), K represents a total rigidity of the spring suspension device (8), and C represents a relative friction coefficient of the wheel truck and ranges from 0.05 to 0.15.

2. The wheel truck of claim 1, wherein a width of the wedge (8*a*) is L=200-600 mm.

* * * * *